US007023314B2

(12) United States Patent
Tolle et al.

(10) Patent No.: US 7,023,314 B2
(45) Date of Patent: Apr. 4, 2006

(54) TRANSFORMER

(75) Inventors: Tobias Georg Tolle, Aachen (DE); Thomas Duerbaum, Langerwehe (DE); Hendrikus Johannes Jacobus Domensino, Eindhoven (NL); Pieter Jan Mark Smidt, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 169 days.

(21) Appl. No.: 10/481,144

(22) PCT Filed: Jul. 1, 2002

(86) PCT No.: PCT/IB02/02629

§ 371 (c)(1),
(2), (4) Date: Dec. 17, 2003

(87) PCT Pub. No.: WO03/005382

PCT Pub. Date: Jan. 16, 2003

(65) Prior Publication Data

US 2004/0164834 A1 Aug. 26, 2004

(30) Foreign Application Priority Data

Jul. 3, 2001 (DE) ..... 101 32 123

(51) Int. Cl.
*H01F 27/29* (2006.01)

(52) U.S. Cl. ..... 336/192; 336/208; 336/198; 336/196

(58) Field of Classification Search ..... 336/83, 336/192, 198, 200, 196, 208
See application file for complete search history.

(56) References Cited

U.S. PATENT DOCUMENTS 4,888,571 A * 12/1989 Kobayashi et al. ..... 336/65
2003/0179062 A1 * 9/2003 Kuwata et al. ..... 336/83

FOREIGN PATENT DOCUMENTS

JP 07086054 A 3/1995
JP 11204345 A * 7/1999

* cited by examiner

*Primary Examiner*—Anh Mai

(57) ABSTRACT

The invention relates to a transformer (10, 10') with a core (11) which has a center piece (11*a*) with a first and a second flange (11*b*, 11*c*), in which a first and a second winding (12, 13) of the transformer (10, 10') are wound on the center piece (11*a*).

Figure 1:
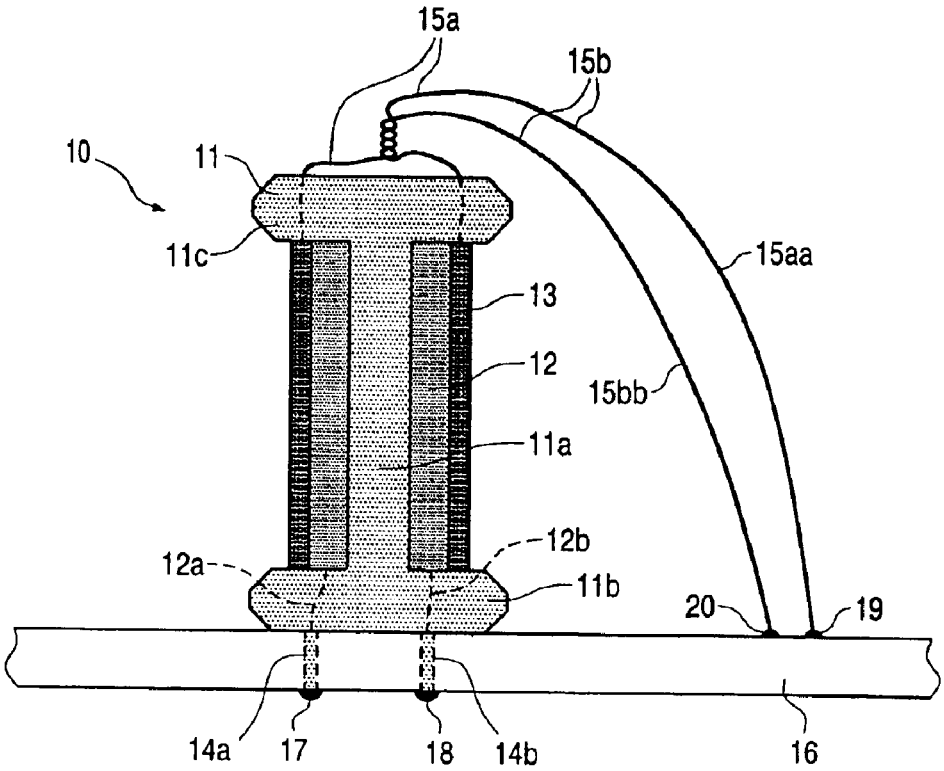

To produce a transformer as compact as possible which allows simple adaptation to limit leakage currents, it is proposed that the winding end pieces (12*a*, 12*b*) of the first winding (12) guided out of the winding body are guided through at least one recess in the first flange (11*b*) and that winding end pieces (15*a*, 15*b*) of the second winding (13) guided out of the winding body are provided which form at least partly loose line ends. Alternatively, the winding end pieces (12*a*, 12*b*) of the first winding (12) guided out of the winding body are guided immediately about the edge of the first flange (11*b*) and connected with connecting elements (14*a*, 14*b*) which are arranged on the side of the first flange (11*b*) opposite the center piece (11*a*).

15 Claims, 2 Drawing Sheets

TRANSFORMER

The invention relates to a transformer with a core which has a center piece with a first and a second flange, in which a first and a second winding of the transformer are wound on the center piece.

JP 07086054 A discloses such a transformer. This also has a base plate lying on one of the flanges with several connecting elements. The connecting elements are arranged on two sides of the base plate. Loose line ends, i.e. with no direct guidance and freely guided through the air, of the primary and secondary winding are each connected releasably with two of the connecting elements; the line ends lie in recesses in the connecting elements.

Such construction elements are designed so that leakage currents are avoided as much as possible i.e. undesirable surface currents between two live parts via non-electrically conductive material lying between the live parts, are to be prevented. The distances between the live parts are known as the leakage paths.

It is an object of the invention to create a transformer as compact as possible which allows simple adaptation to limit leakage currents.

The object is achieved in that the winding end pieces of the first winding passed out of the winding body are guided through at least one recess in the first flange and in which winding end pieces of the second winding guided out of the winding body are provided which form at least partly loose line ends.

Using the loose line ends of the second winding, in a simple manner unacceptable leakage currents can be avoided if the distance of the electrical contact points with which the loose line ends are connected and points which lie on the voltage potential of the first winding are selected sufficiently large depending on application. The remaining part of the transformer including the connecting elements connected with the first winding e.g. connecting pins, can be designed in very compact form.

The transformer has in particular a core of ferrite which in particular is designed as one piece. Such cores can be produced very compact. The winding end pieces of the second winding can for example be guided in the area of the center piece from the winding body and transform directly into the loose line ends. As an alternative the winding end pieces can be guided to the outside through at least one recess in the second flange; on the outside of the second flange the winding end pieces are fixed for example by twisting in order then to transform into the loose line ends. The winding end pieces of the first winding are preferably connected with connecting pins which are placed on the first flange. In a variant the connecting elements or pins are placed not directly on the first flange but a base plate is provided which is placed on the first flange and carries the connecting elements. Such a base plate can be produced separately and in a later work process placed on the first flange. In a variant the base plate extends beyond the first flange and in this outer area has connecting elements which are connected with the loose line ends of the second winding. The transformer with such a base plate can then later be mounted on a circuit board where the contact between the loose line ends and the associated connecting elements on the base plate was created during transformer production and need no longer be created on production of the circuit board.

The object is also achieved in that the winding end pieces of the first winding guided out of the winding body are wound directly about the periphery of the first flange and connected with the connecting elements arranged on the side of the first flange opposite the center piece, and in that winding end pieces of the second winding guided out of the winding body are provided which form partly loose line ends. In this solution no recesses are required in the first flange. In a variant of this transformer a connecting module is provided to which the connecting elements are attached. Recesses in the connecting module serve to guide the winding end pieces.

Figure 2:
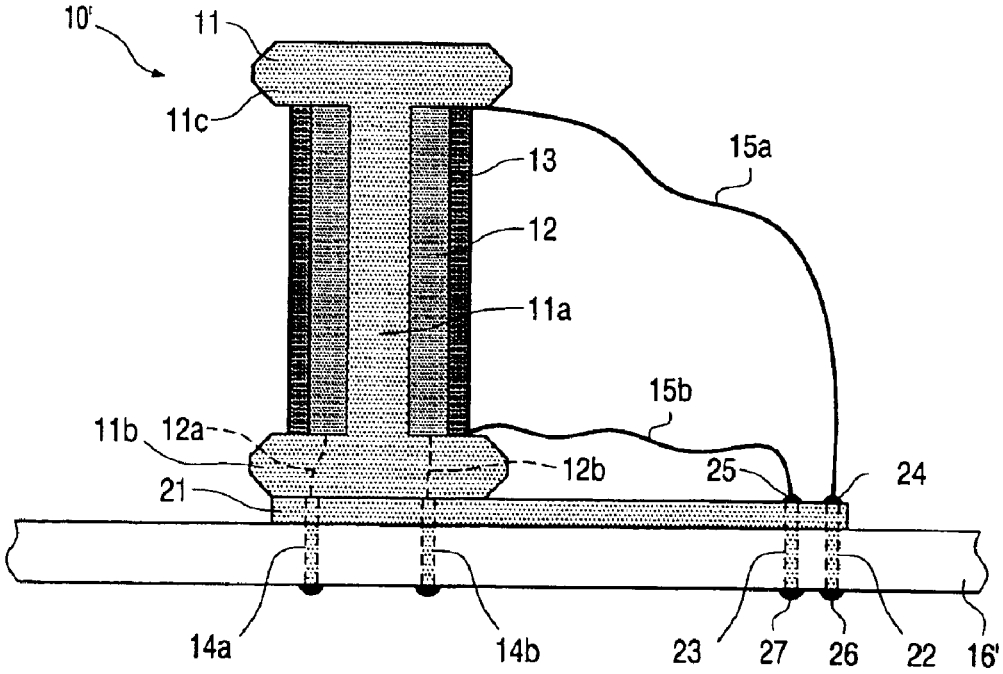
Figure 3:
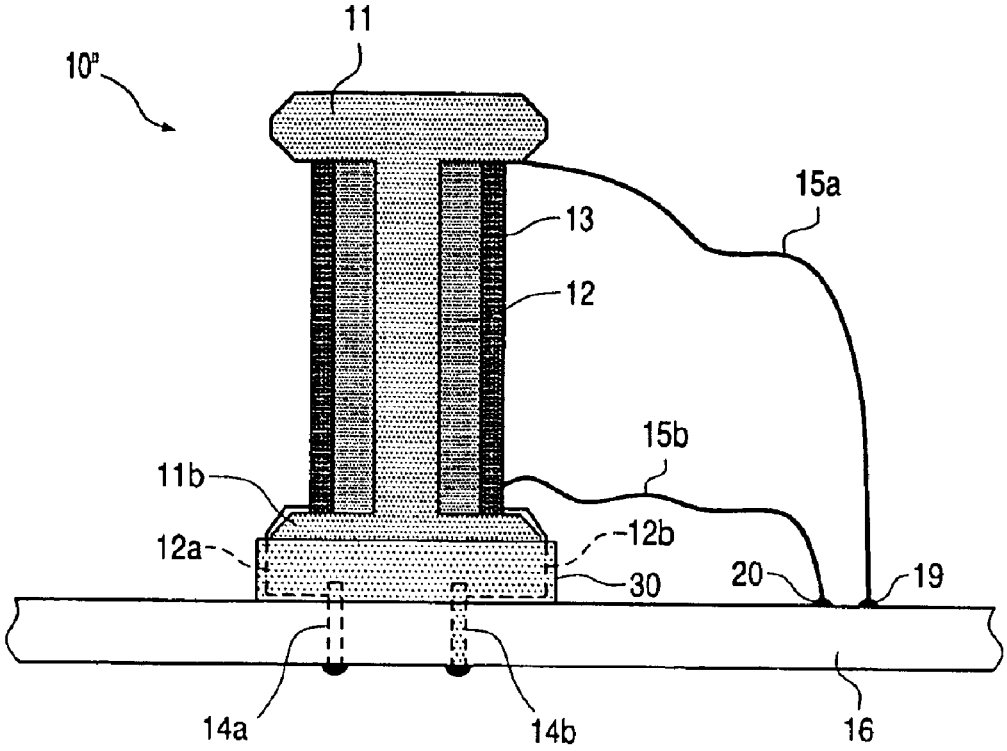

The invention also relates to a circuit board with a transformer according to one of the embodiments described above in which the loose line ends are connected directly The invention will be further described with reference to examples of embodiment shown in the drawings, to which, however, the invention is not restricted. These show in:

FIGS. 1 to 3 each a transformer mounted on a circuit board and

Figure 4:
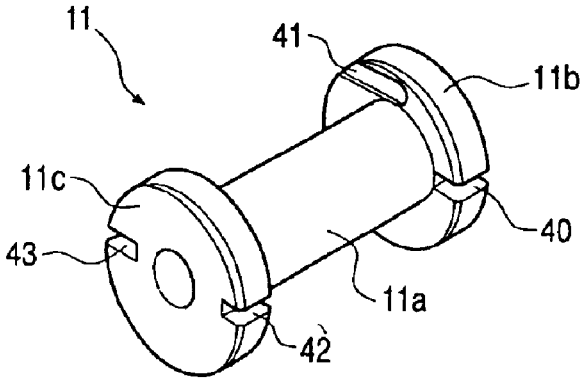

FIG. 4 an example of a transformer core.

FIG. 1 shows a transformer 10 with a core 11 arranged here as a ferrite core. The core 11 takes the form of a drum; it comprises a center piece 11*a* and two flanges 11*b* and 11*c*. The core 11 is preferably formed as one piece; flanges 11*b* and 11*c* may, however, also be separate components connected to the center piece 11*a* by means of an adhesive joint. On the center piece 11*a* are wound a first winding 12 (for example, a transformer primary winding) and a second winding 13 (for example a transformer secondary winding). In order to ensure adequate insulation between the windings 12 and 13, the outer winding 13 preferably has a triple layer sheath of insulating material (not shown) where then the winding 12 can be a wire with a single lacquer insulation. The transformer winding 12 has winding end pieces 12*a* and 12*b* which are guided through recesses in flange 11*b* (see FIG. 4) to the outside of flange 11*b* lying opposite the center part 11*a*. On the outside of flange 11*b* are arranged connection elements 14*a* and 14*b* formed as connecting pins. The connecting pins 14*a* and 14*b* are connected with the outside of flange 11*b* by means of an adhesive joint for example. The winding end piece 12*a* is connected electrically with the connecting piece 14*a*. The winding end piece 12*b* is electrically connected with the connecting pin 14*b*.

The transformer winding 13 has winding end pieces 15*a* and 15*b* which are guided through recesses in flange 11*c* (see FIG. 4) to the outside of flange 11*c* lying opposite the center piece 11*a*. The winding end pieces 15*a* and 15*b* emerging on the outside of flange 11*c* are twisted together or otherwise mechanically connected together in the immediate vicinity of flange 11*c* and then transformed into loose line ends 15*aa* and 15*bb*.

The transformer 10 is arranged on a circuit board 16. The connecting pins 14*a* and 14*b* are guided through bores in the circuit board 16 and connected electrically with the circuits of the circuit board 16 via contact points 17 and 18 by solder joints. The line ends 15*aa* and 15*bb* are electrically connected at contact points 19 and 20 with circuits of the circuit board 16 by solder joints. In an embodiment the line ends 15*aa* and 15*bb* are passed through holes in circuit board 16 and electrically connected on the underside of circuit board 16 with circuits of circuit board 16 by solder joints; this allows the use of the invention also in circuit boards on which solder joints are provided on one side only. For reasons of clarity only one section of the circuit board 16 is shown; the representation of other construction elements and circuits arranged on the circuit board has also been omitted.

Contact points 19 and 20 are arranged so far from the transformer core with windings 12 and 13 that leakage currents are adequately prevented, i.e. leakage paths can thus be reduced to prespecifiable lengths. The solder connections at the contact points 19 and 20 are preferably produced manually here.

FIG. 2 shows a variant of the example of embodiment in FIG. 1. The modification of the transformer 10 in FIG. 1 is indicated with reference character 10'. Transformer 10' has a base plate 21 consisting of insulating material and on which is arranged the outside surface of flange 11*b* opposite the center part 11*a* of the core 11. The base plate 21 has holes through which connecting pins 14*a* and 14*b* are guided. The winding end pieces 15*a* and 15*b* in the examples in FIG. 2 are guided not through recesses in flange 11*c* but emerge from the winding body with windings 12 and 13 between flanges 11*b* and 11*c* and extend as loose line ends up to the contact points 24 and 25 on the base plate 21 where they are soldered with connecting pins 22 and 23; to facilitate contact in production, the connecting pins 22 and 23 in one design project above the top of the base plate 21 (not shown) where then the loose line ends are wound about the projecting parts of the connecting pins before they are soldered as required. The connecting pins 22 and 23 are passed through holes in the base plate 21 and through holes in the correspondingly modified circuit board 16, indicated with reference 16', where they are soldered on the underside of circuit board 16' at contact points 26 and 27 with circuits of the circuit board 16'. The base plate 21 extends sideways so far over the lower outside of the flange 11*b* that the contact points 24 and 25 lie so far out that the leakage currents are avoided sufficiently.

In the example of embodiment in FIG. 3 the winding end pieces 15*a* and 15*b* as in FIG. 2 are guided between flanges 11*b* and 11*b* of core 11 out of the winding body as loose line ends and contacted directly with the circuit board 16 at contact points 19 and 20. A connecting module 30 here made of plastic is placed on the flange 11*b* and carries the connecting pins 14*a* and 14*b*. The connecting module 30 also has side recesses (not shown) which guide the winding end pieces 12*a* and 12*b* of winding 12 directly about the edge of the flange 11*b* to the connecting pins 14*a* and 14*b*. The connecting pins 14*a* and 14*b* as in FIG. 1 are passed through holes in the circuit board 16 and electrically contacted with circuits of the circuit board 16 on the underside. The modification of transformer 10 with core 11, windings 12 and 13, connecting module 30 and connecting pins 14*a* and 14*b* is indicated with the reference 10".

FIG. 4 shows an example of a core 11 designed as a ferrite core. Flanges 11*b* and 11*c* each have two recesses referred to as 40 and 41 or 42 and 43. Through the recesses 40 and 41 are guided the winding end pieces 12*a* and 12*b* in the embodiments in FIGS. 1 and 2. In the embodiment in FIG. 1 the recesses 42 and 43 serve to guide the winding end pieces 15*a* and 15*b*. In the embodiment in FIG. 2 the recesses 42 and 43 are not necessary. In the embodiment according to FIG. 3 neither the recesses 40 and 41 nor recesses 42 and 43 are necessary.

The invention is not restricted to the special embodiments shown in FIGS. 1 to 4. The manner and method of guiding the winding end pieces through recesses in the core 11 or as in FIG. 3 directly about the edge of the core flange can be combined as required. In another variant not shown, as in FIG. 2 a base plate 21 is provided but this extends essentially only over the lower outer surface of the flange 11*b*. Consequently, the connecting pins 22 and 23 are not required in this embodiment and the contacting of the winding end pieces 15*a* and 15*b* is achieved as in FIG. 1 by contact points 19 and 20 arranged immediately on the circuit board 16.

What is claimed is:

1. A transformer (10, 10') with a core (11) which has a center piece (11*a*) with a first and a second flange (11*b*, 11*c*), in which a first and second winding (12, 13) of the transformer (10, 10') are wound on the center piece (11*a*), in which the winding end pieces (12*a*, 12*b*) of the first winding (12) guided out of the winding body are guided through at least one recess in the first flange (11*b*) and upon exiting said at least one recess in the first flange (11*b*), the winding end pieces (12*a*, 12*b*) being further guided through at least one bore of a circuit board upon which said transformer (10, 10') is supported, and in which winding end pieces (15*a*, 15*b*) of the second winding (13) guided out of the winding body are provided which form at least partly loose line ends.

2. A transformer as claimed in claim 1, wherein the core (11) is a ferrite core.

3. A transformer as claimed in claim 1, wherein the winding end pieces (15*a*, 15*b*) of the second winding (13) are guided through at least one recess (42, 43) of the second flange (11*c*).

4. A transformer as claimed in claim 1, wherein the winding end pieces (12*a*, 12*b*) of the first winding (12) are connected with connecting pins (14*a*, 14*b*) placed on the first flange (11*b*).

5. A transformer as claimed in claim 1, wherein on the first flange (11*b*) is placed a base plate (21) with connecting elements (14*a*, 14*b*) connected with the winding end pieces (12*a*, 12*b*) of the first winding (12), so that the connecting elements (14*a*, 14*b*) lie opposite the first flange (11*b*).

6. A transformer as claimed in claim 5, wherein the base plate (21) extends beyond the first flange (11*b*) and in that two further connecting elements (22, 23) are provided which are mounted on the part of the base plate (21) extending beyond the outside of the first flange (11*b*) and connected with the loose line ends (15*a*, 15*b*) of the second winding (13).

7. A transformer as claimed in claim 1, wherein the winding end pieces (15*a*, 15*b*) of the second winding (13) are guided through at least one recess (42, 43) of the second flange (11*c*).

8. A transformer (10") with a core (11) which has a center piece (11*a*) with a first and a second flange (11*b*, 11*c*) on the two ends of the center piece (11*a*), in which a first and a second winding (12, 13) of the transformer (10") are wound on the center piece (11*a*), in which the winding end pieces (12*a*, 12*b*) of the first winding (12) guided out of the winding body are guided directly around the edge of the first flange (11*b*) and connected with connecting elements (14*a*, 14*b*) which are arranged on the side of the first flange (11*b*) opposite the center piece (11*a*), and in which winding end pieces (15*a*, 15*b*) of the second winding (13) guided out of the winding body are provided which form at least partly loose line ends.

9. A transformer as claimed in claim 8, wherein the connecting elements (14*a*, 14*b*) are attached to a connecting module (30) which is placed on the first flange (11*b*) and which has at least one recess through which are guided the winding end pieces (12*a*, 12*b*) of the first winding (12).

10. A circuit board with a transformer (10") with a core (11) that has a center piece (11*a*) with a first and a second flange (11*b*, 11*c*) on the two ends of the center piece (11*a*), in which a first and a second winding (12, 13) of the transformer (10") are wound on the center piece (11*a*), in which the winding end pieces (12*a*, 12*b*) of the first winding (12) guided out of the winding body are guided directly around the edge of the first flange (11*b*) and connected with connecting elements (14*a*, 14*b*) which are arranged on the side of the first flange (11*b*) opposite the center piece (11*a*), the winding end pieces (12*a*, 12*b*) of the first winding (12) being connected with connecting pins (14*a*, 14*b*) placed on the side of the first flange (11*b*) opposite the center piece (11*a*), and in which winding end pieces (15*a*, 15*b*) of the second winding (13) guided out of the winding body are provided which form at least partly loose line ends and which are connected directly with contact points (19, 20) on the circuit board (16).

11. A transformer (10, 10') with a core (11) which has a center piece (11*a*) with a first and a second flange (11*b*, 15*c*), in which a first and second winding (12, 13) of the transformer (10, 10') are wound on the center piece (11*a*), in which the end pieces (12*a*, 12*b*) of the first winding (12) guided out of the winding body are guided through at least one recess in the first flange (11*b*), the winding end pieces (12*a*, 12*b*) of the first winding (12) being connected with connecting pins (14*a*, 14*b*) placed on the first flange (11*b*), and in which winding end pieces (15*a*, 15*b*) of the second winding (13) guided out of the winding body are provided which form at least partly loose line ends.

12. A transformer as claimed in claim 11, wherein the core (11) is a ferrite core.

13. A transformer (10") with a core (11) which has a center piece (11*a*) with a first and a second flange (11*b*, 11*c*) on the two ends of the center piece (11*a*), in which a first and second winding (12, 13) of the transformer (10") are wound on the center piece (11*a*), in which the winding end pieces (12*a*, 12*b*) of the winding (12) guided out of the winding body are guided directly around the edge of the first flange (11*b*) and connected with connecting elements (14*a*, 14*b*) which are arranged on the side of the first flange (11*b*) opposite the center piece (11*a*), the winding end pieces (12*a*, 12*b*) of the first winding (12) being connected with connecting pins (14*a*, 14*b*) placed on the side of the first flange (11*b*) opposite the center piece (11*a*), and in which winding end pieces (15*a*, 15*b*) of the second winding (13) guided out of the winding body are provided which form at least partly loose line ends.

14. A transformer as claimed in claim 13, wherein the connecting elements (14*a*, 14*b*) are attached to a connecting module (30) which is placed on the first flange (11*b*) and which has at least one recess through which are guided the winding end pieces (12*a*, 12*b*) of the first winding (12).

15. A circuit board (16) with a transformer (10, 10') with a core (11) which has a center piece (11*a*) with a first and a second flange (11*b*, 11*c*), in which a first and a second winding (12, 13) of the transformer (10, 10') are wound on the center piece (11*a*), in which the winding end pieces (12*a*, 12*b*) of the first winding (12) guided out of the winding body are guided through at least one recess in the first flange (11*b*), and upon exiting said at least one recess in the first flange (11*b*), the winding end pieces (12*a*, 12*b*) being further guided through at least one bore of said circuit board, and in which winding end pieces (15*a*, 15*b*) of the second winding (13) guided out of the winding body are provided which form at least partly loose line ends and which are connected directly with contact points (19, 20) on the circuit board (16).

* * * * *